US005644874A

United States Patent [19]

McKann

[11] Patent Number: 5,644,874

[45] Date of Patent: Jul. 8, 1997

[54] LIGHT FRAME SYSTEM

[75] Inventor: H. Smith McKann, Fredericksburg, Va.

[73] Assignee: General Products Company, Inc., Fredericksburg, Va.

[21] Appl. No.: 584,550

[22] Filed: Jan. 11, 1996

Related U.S. Application Data

[63] Continuation-in-part of Ser. No. 415,460, Apr. 3, 1995, abandoned.

[51] Int. Cl.[6] ..... E06B 3/26

[52] U.S. Cl. ..... 52/202; 52/208; 52/212; 52/455; 52/656.4; 49/501

[58] Field of Search ..... 52/202, 207, 208, 52/212, 656.9, 656.4, 217, 204.5, 204.591, 204.595, 476, 455; 40/780, 782, 783, 784; 49/501, 502, 503

[56] References Cited

U.S. PATENT DOCUMENTS

| | | | |
|---|---|---|---|
| 1,171,444 | 2/1916 | Larson et al. . | |
| 1,227,066 | 5/1917 | Ohe . | |
| 1,323,753 | 12/1919 | Gogay . | |
| 1,850,180 | 3/1932 | Pinney | 40/780 X |
| 2,009,142 | 7/1935 | Marsh, Jr. | 20/56.5 X |
| 2,654,920 | 10/1953 | Kessler | 52/402 X |
| 3,034,612 | 5/1962 | Jourdan | 40/782 X |
| 3,263,357 | 8/1966 | Carleton | 40/780 X |
| 3,305,998 | 2/1967 | Deisenroth | 52/656.5 X |
| 3,376,670 | 4/1968 | Jones | 49/501 X |
| 3,760,543 | 9/1973 | McAllister | 52/204.591 X |
| 3,949,526 | 4/1976 | Sherlock et al. | 49/501 |
| 3,969,857 | 7/1976 | Stark | 52/208 |
| 4,024,691 | 5/1977 | Hansen et al. | 52/656.5 X |
| 4,074,483 | 2/1978 | Vickstrom | 52/202 |
| 4,259,818 | 4/1981 | Stark | 52/208 |
| 4,413,397 | 11/1983 | McKann | 52/656.5 X |
| 4,430,836 | 2/1984 | McKann | 52/656.5 X |
| 4,466,220 | 8/1984 | Lewkowitz | 52/202 X |
| 4,550,542 | 11/1985 | La See | 52/656.5 X |
| 4,920,718 | 5/1990 | Artwick et al. | 52/656.5 X |
| 4,924,649 | 5/1990 | Taylor | 52/656 |
| 4,947,597 | 8/1990 | Simpson | 52/204.591 |
| 5,105,597 | 4/1992 | Wilkening | 52/455 |
| 5,123,211 | 6/1992 | Schlicht et al. | 52/202 |

*Primary Examiner*—Wynn E. Wood
*Assistant Examiner*—Winnie Yip
*Attorney, Agent, or Firm*—Roylance, Abrams, Berdo & Goodman, L.L.P.

[57] ABSTRACT

A frame assembly for a door light is formed with inner and outer half-frames sandwiching a translucent panel. The half-frames are separately and similarly formed of sheet material, each with a plurality of substantially similar side members defining a closed polygon. Each side member includes, in cross-section, a flat portion for supporting the frame in an opening in a support, a face portion extending from the flat portion towards the center of the polygon, a third portion extending inwardly from the face portion toward the other half-frame and to a position adjacent the translucent panel, a fourth portion extending from the third portion parallel to the face portion and away from the center of the polygon, and a fifth portion extending inwardly from the fourth portion toward the other half-frame and about a peripheral edge of the translucent panel. Fasteners couple the half-frames and secure the half-frames in the support opening. Each half-frame is formed from an elongated strip of sheet material which is bent along fold lines extending parallel to the longitudinal axis of the strip to form the various portions and then bent at an intermediate mitered notch to form a corner. The ends of the strip are also mitered to form a mitered frame corner.

27 Claims, 4 Drawing Sheets

FIG. 3
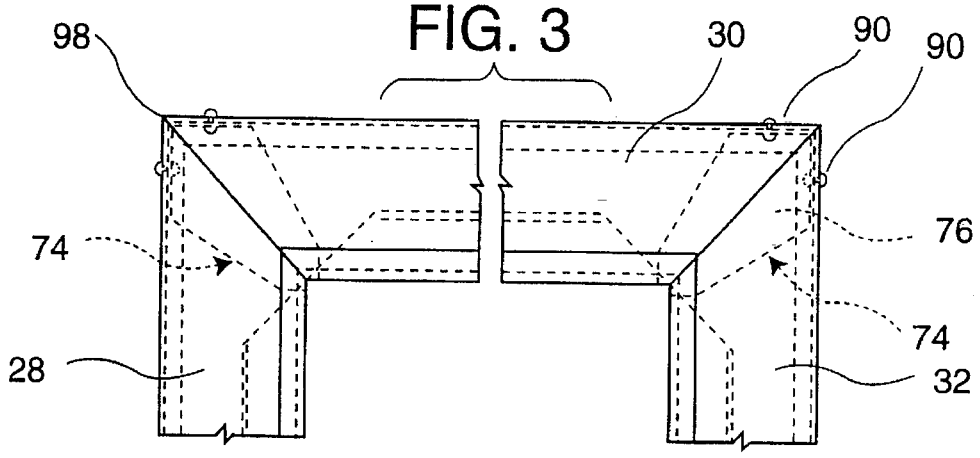
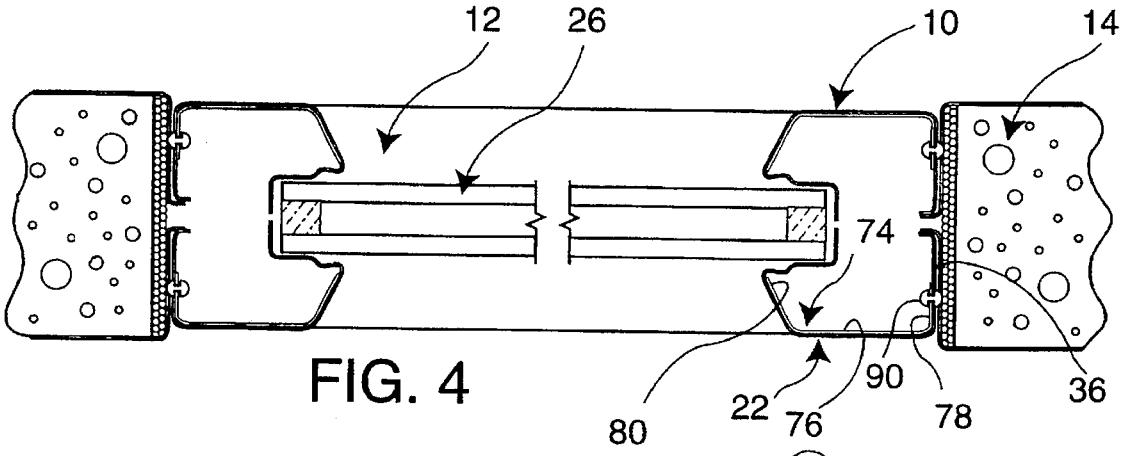
FIG. 4
FIG. 5
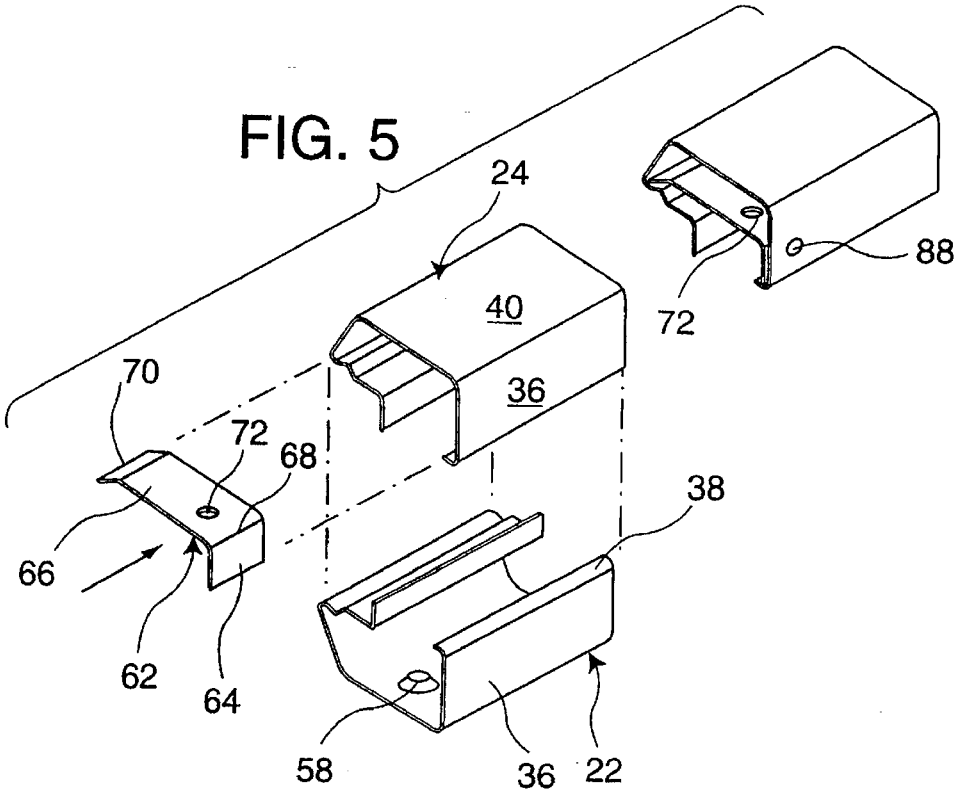

FIG. 6
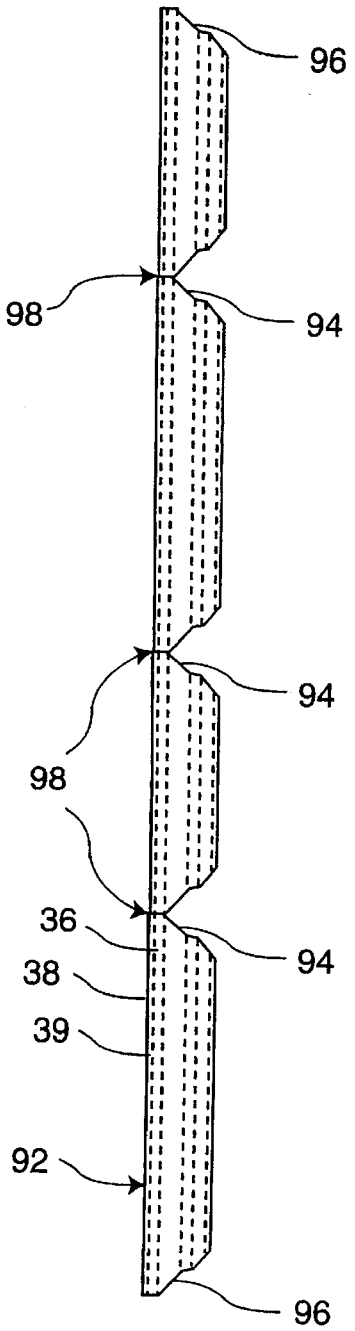
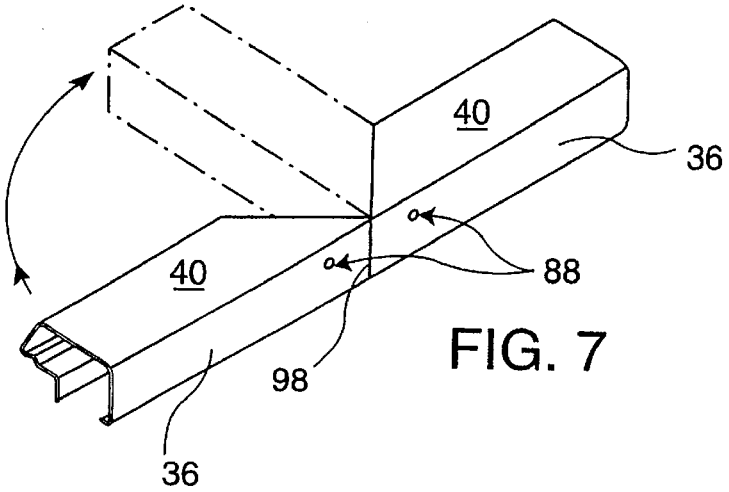
FIG. 7
FIG. 8
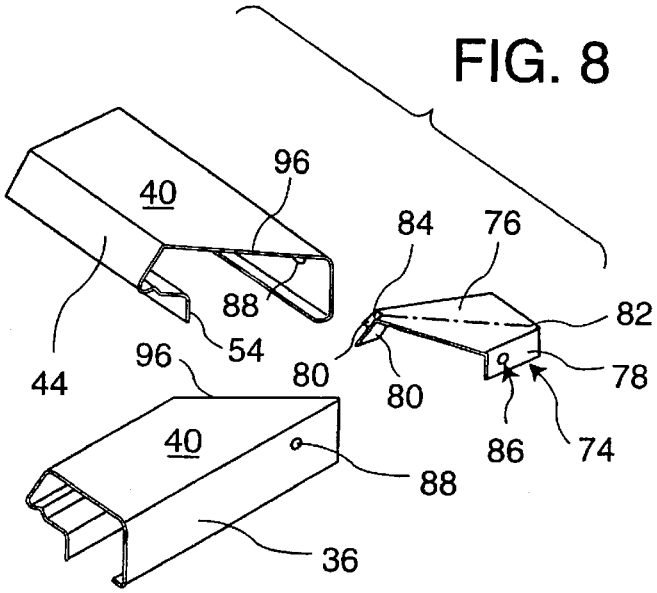

FIG. 9
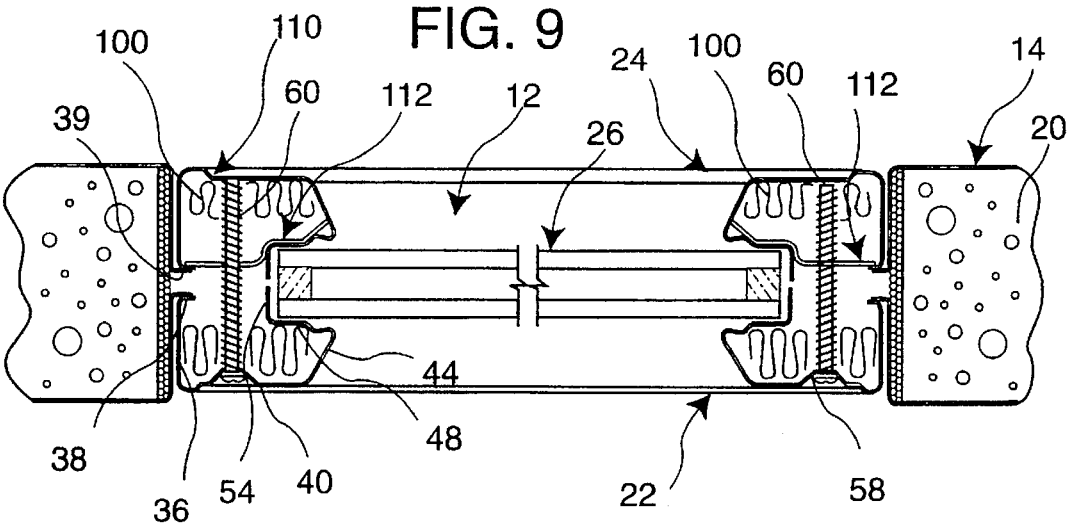
FIG. 10
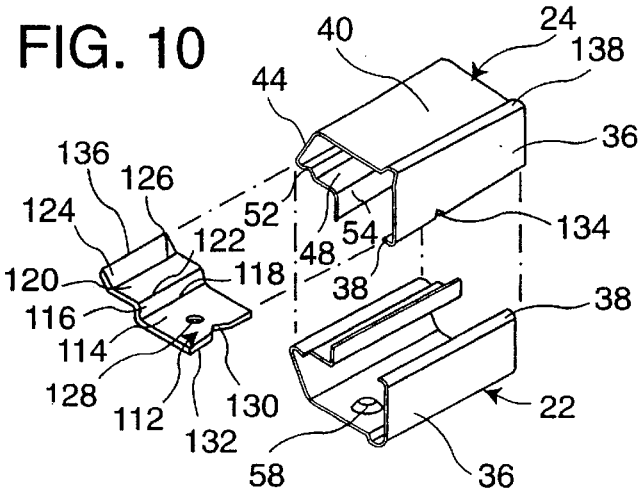
FIG. 11
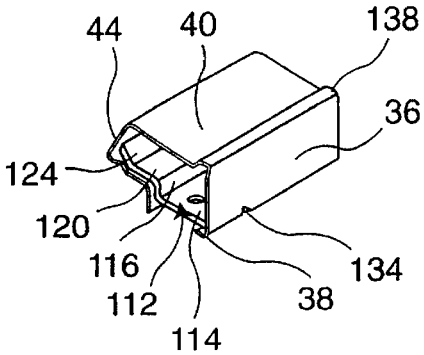
FIG. 12
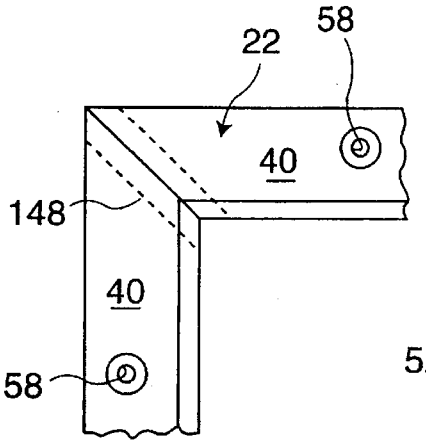
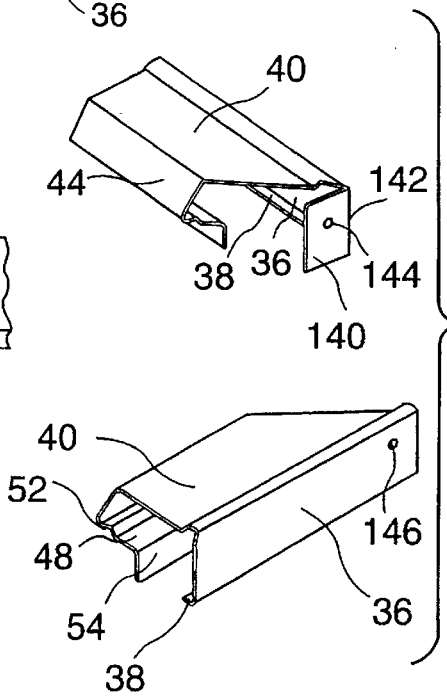
FIG. 13

LIGHT FRAME SYSTEM

CROSS-REFERENCE TO RELATED APPLICATION

This application is a continuation-in-part of U.S. patent application Ser. No. 08/415,460 to H. Smith McKann, filed Apr. 3, 1995, now abandoned.

FIELD OF THE INVENTION

The present invention relates to a frame assembly for a door light and to a method of making a frame assembly for a door light. The frame is formed from two similarly constructed half-frames produced from elongated strips of sheet material. The half-frames secure a translucent panel therebetween for mounting in a door opening.

BACKGROUND OF THE INVENTION

Doors used as replacements or for new construction are conventionally produced of sheet metal. These doors, particularly when used as outside entrances, as opposed to interior doors, preferably have one or more window sections. These window sections are known as lights and are formed in the door. Numerous frame assemblies have been proposed for use as door light frames.

Door light frames conventionally comprise inner and outer half-frames which sandwich a translucent panel therebetween and support the panel within an opening formed in the door. Each half-frame is formed separately and has a plurality of side members defining a close polygon. Usually, the side members of each frame are separately formed and then attached together by welding, for example, U.S. Pat. No. a 3,004,641 to Johnson, or by corner attaching members, for example, U.S. Pat. No. 4,024,691 to Hansen et al. and U.S. Pat. No. 3,949,526 to Sherlock et al. These conventional methods of forming half-frames are difficult, time-consuming and expensive. Additionally, these side frames are relatively weak at their side member connections. When the side members are welded together to form the half-frames, such welding prevents the use of pre-painted metal strips for forming the frames and require finishing operations after the frame is formed.

Another disadvantage of conventional door systems involves the use of differently formed members for the inner and outer half-frames. Manufacturing and assembly costs are significantly increased by using two differently formed half-frames to produce the frame assembly.

Numerous fastener systems have been used to secure the half-frames together and to the door. Arrangements including threaded fasteners are disclosed in U.S. Pat. Nos. 4,430,836 and 4,413,397 to McKann, the subject matter of each patent being incorporated herein by reference. However, these arrangements require the relatively precise relative positioning of the fastener parts or of the holes in the half-frames for the fastener parts. The fastener means are not readily adjustable to permit realignment of the fastener mechanism during assembly. Further, these mechanisms use the fastener mechanism for supporting the frame, which supporting complicates assembly.

Conventional door light frame systems often are difficult to adequately insulate. Thermal insulation can be a significant problem, particularly for metal frames which may readily conduct heat between the inner and outer half-frames.

Some conventional door light frame systems are disadvantageous in that the fastener means are exposed on the outer half-frame. Such exposure requires special treatment to obscure that fastener end, thereby complicating assembly.

BRIEF DESCRIPTION OF THE INVENTION

An object of the present invention is to provide a frame assembly for a translucent panel which is simple and economical to manufacture and install, and which is of rugged construction and has good insulation characteristics.

A further object of the present invention is to provide a frame assembly for a translucent panel which can be easily and simply secured within a door opening.

Another object of the present invention is to provide a method of simply and economically manufacturing a frame assembly for a translucent panel which is attractive and secure.

The foregoing objects are basically obtained by a frame assembly for a door light comprising inner and outer half-frames sandwiching a translucent panel therebetween. Each of the half-frames is separately and substantially similarly formed of sheet material, and have a plurality of substantially similar side members defining a closed polygon. Each side member includes, in cross-section, a flat portion for supporting the frame in an opening in a support, a face portion extending in a generally perpendicular direction from the flat portion toward the center of the polygon, a third portion extending generally inwardly from the face portion toward the other half-frame to a position adjacent the translucent panel, a fourth portion extending from the third portion in a direction generally parallel to the face portion and away from the polygon center, and a fifth portion extending inwardly from the fourth portion toward the other half-frame and about a peripheral edge of the translucent panel. Fastener means couples the half-frames and secures the half-frames in the support opening.

By forming the frame assembly in this manner, the frame can be formed by deforming sheet material into the desired shape without welding. Thus, pre-painted sheet material can be used effectively to form the frame assembly. The fifth portions, extending around the peripheral edge of the translucent panel, provide a secure and positive mounting of the translucent panel. Since the basic structure of each half-frame is identical, except for the fastening means which are subsequently added, only a single half-frame construction need be formed thereby simplifying and economizing production.

The foregoing objects are also obtained by a method of forming a frame assembly for a door light, comprising forming elongated strips of sheet material, such that each has a longitudinal axis, mitered longitudinal ends and at least one mitered notch between the longitudinal ends. Each longitudinal strip is then bent along fold lines extending parallel to the longitudinal axis to form a half-frame including a flat portion, a face portion extending in a generally perpendicular direction from the flat portion, a third portion extending at an angle from the face portion in the same general direction as the flat portion, a fourth portion extending from the third portion in the same general direction as and parallel to the face portion and a fifth portion extending from the fourth portion generally parallel to and in the same direction as the flat portion, such that the notch extends through the face portion, third portion, fourth portion and fifth portion but not through the base portion. Each flat portion is bent at a closed end of the notch to form a corner of each half-frame. A translucent panel is then located between the half-frames, and the half-frames are secured with the translucent panel by fastener means.

This method provides a simple and inexpensive manufacture and assembly operation. Additionally, the method produces a light frame assembly having the same advantages discussed above.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure:

FIG. 3 is a partial, enlarged front elevational view of the frame assembly of FIG. 1;

FIG. 4 is a bottom plan view in section taken along line 4—4 of FIG. 1;

FIG. 5 is a partial, exploded perspective view of the frame assembly of FIG. 1;

FIG. 6 is a front elevational view of an elongated strip or blank of sheet metal for forming a half-frame according to the first embodiment of the present invention, prior to bending;

FIG. 7 is a partial, perspective view illustrating a bent corner arrangement of the frame assembly of FIG. 1;

FIG. 8 is a partial, perspective view illustrating a corner arrangement between two abutting, mitered ends of the frame assembly of FIG. 1;

FIG. 9 is a bottom plan view in section of a frame assembly with a translucent panel mounted therein according to a second embodiment of the present invention;

FIG. 10 is a partial, exploded perspective view of the frame assembly of FIG. 9;

FIG. 11 is a partial perspective view of the frame assembly of FIG. 9;

FIG. 12 is a front elevational view of a corner of a half-frame according to the second embodiment of the present invention, prior to bending; and FIG. 13 is a partial, perspective view illustrating a corner arrangement between two abutting, mitered ends of the frame assembly according to the second embodiment of the present invention.

DETAILED DESCRIPTION OF THE INVENTION

Figure 1:
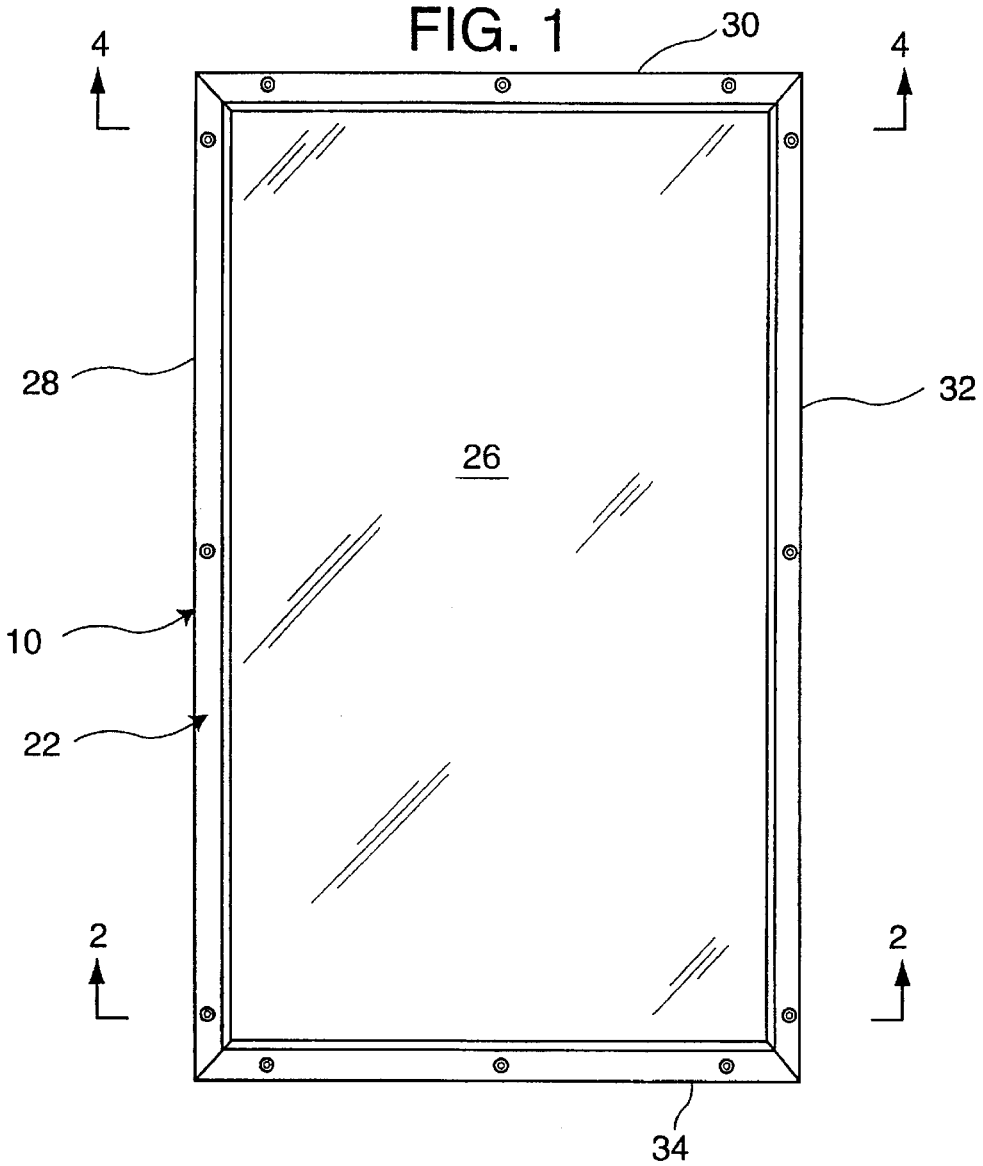
FIG. 1 is a front elevational view of a frame assembly with a translucent panel mounted therein according to a first embodiment of the present invention.
Figure 2:
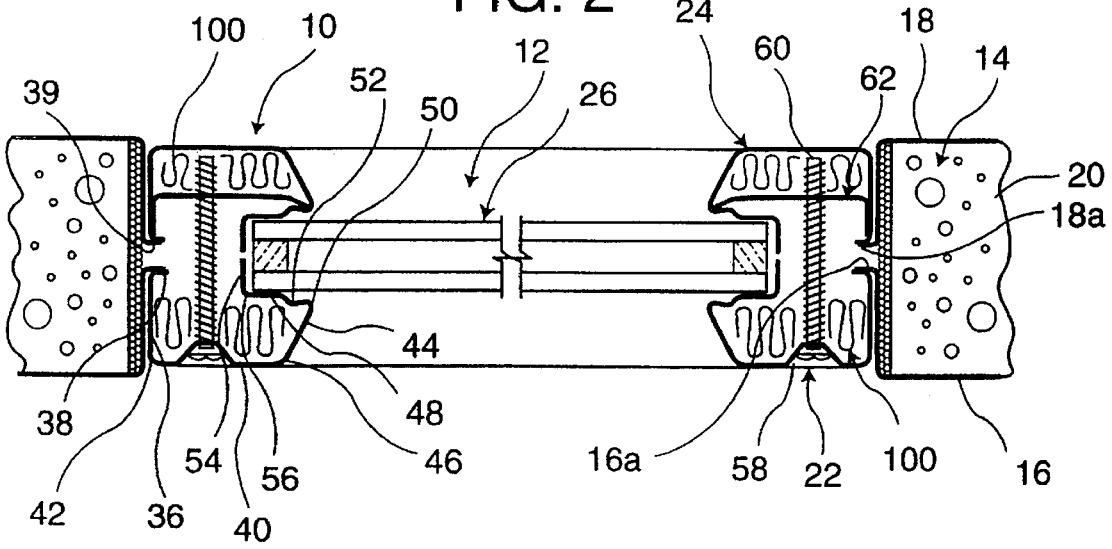
FIG. 2 is a bottom plan view in section taken along line 2—2 of FIG. 1.

Referring initially to FIGS. 1 and 2, a frame assembly 10 is mounted in an opening 12 of a door 14 or other support. The mounting of the frame in the door or other support is also disclosed in U.S. Pat. No. 4,430,836 to McKann.

Conventional door 14 comprises an inner sheet 16 and an outer sheet 18 forming the major surfaces of the door and having decorative relief portions normally formed therein. Sheets are connected by transverse edges with a void between the sheets and with an insulating foam material 20. Since the door construction is conventional, the door is not described further in detail.

Frame assembly 10 comprises an inner half-frame 22 and an outer half-frame 24. The half-frames sandwich a translucent panel 26 between them for supporting the translucent panel in door opening 12. Translucent panel 26 is conventional, and thus, is not described further in detail.

Each half-frame is separately formed but substantially similar or identical in construction of sheet material, preferably sheet metal. Thus, a single half-frame can be formed for use as an inner or outer half-frame. Each half-frame includes a plurality of substantially similar side members which define a closed polygon. Any desired polygonal shape can be provided. Additionally, the side members can be curvilinear.

In the first embodiment, each half-frame defines a polygonal shape having four side members 28, 30, 32, and 34. The four side members have substantially identical cross-sectional configurations. In view of the substantially identical nature of the cross-sectional configuration of each side member of each half-frame, only one will be described in detail.

In cross-section, each side member comprises a generally planar flat first portion 36 which engages the surfaces of the door defining opening 12. The free or inner edge of flat portion 36 is bent at a substantially 90 degree angle along a fold or bend line 39 to define a lip 38. Lip 38 engages radially bent portions 16*a* and 18*a* of door sheets 16 and 18, respectively.

On the outer edge of flat portion 36, a face or second portion 40 extends along a bend or fold line 42 substantially perpendicularly from the flat portion toward the center of the polygon defined by the frame assembly. A third portion 44 extends in an inward direction at a generally obtuse angle from face portion 40 along fold or bend line 46. The third portion extends from the face portion for a distance to a position adjacent translucent panel 26. A fourth portion 48 extends from the third portion in a direction generally parallel to face portion 40 along fold or bend line 50 and in a direction from the frame polygon center.

Adjacent fold line 50, fourth portion 48 comprises a recess 52. Recess 52 provides a space of sufficient size and shape to permit caulking to be located between adjacent frame edge and the translucent panel. Since the recess is undercut, i.e., decreases in transverse dimension in a direction toward the center of the frame polygon, the caulking is locked into the frame. Additionally, this space can provide an attachment facilitating insertion of clips for securing a decorative grill to the frame assembly and over the translucent panel.

A fifth portion 54 extends inwardly from fourth portion 48 along fold or bend line 56. The fourth and fifth portions are substantially perpendicular to one another such that fourth portion can overlie a face surface of the translucent panel, while the fifth portion engages a peripheral edge of the translucent panel. The engagement of the translucent panel by the fourth and fifth portions provides a positive connection between the frame assembly and the translucent panel to securely and precisely locate the translucent panel in the desired position. Additionally, the fourth and fifth portions provide a definitive seat for the translucent panel within the frame assembly, independent of the fasteners, to facilitate mounting of the translucent panel in the frame assembly.

Inner half-frame 22 has a plurality of countersunk bores 58 formed in its face portions 40. The bores 58 receive externally threaded fastener screws 60 for securing the two half-frames together within door opening 12. As best illustrated in FIGS. 2 and 5, fastener screws 60 engage an L-shaped clip member 62 adjustably mounted in outer half-frame 24.

The generally L-shaped clip member, as illustrated in FIG. 5, comprises a first leg 64 and a second leg 66. First leg 64 overlies and abuts the inside surface of flat portion 36. The free edge of the first leg abuts the inner surface of lip 38. The second leg extends substantially perpendicularly along a fold or bend line 68 from first leg 64. In its assembled position, second leg 66 is substantially parallel to face portion 40. A bent end lip 70 is formed adjacent the free edge of second leg 66 and engages an inside surface of fourth portion 48 adjacent fold line 50. An internally threaded opening 72 extends through second leg 66 between end lip 70 and first leg 64. When clip 62 is properly located within outer half-frame 24, and the inner and outer half-frames are located adjacent each other, countersunk bore 58 is coaxially aligned with opening 72 to engage threaded fastener 60.

When the half-frames are assembled in position relative to one another, each threaded fastener 60 is passed through a bore 58 to engage threaded opening 72 in the respective clip member mounted in the outer frame member. Since clip member 62 merely abuts fourth portion 48 and lip 38 of the outer half-frame, it can be adjusted by sliding along the length of each outer frame side member to its aligned position. When the screw is tightened, the clip will frictionally engage the fourth portion and the lip to positively and securely retain the clip member and thereby the half-frame members in their proper position.

Bores 58 need only be formed in the inner half-frame. No bores are necessary in the outer half-frame. Thus, additional finishing of the outer frame is not necessary. Moreover, a more secure structure is provided since there is no access to these screws from the outer surface of the door.

The corner of each half-frame is reinforced by a separate corner clip 74. The structure and the positioning of the corner clips is best illustrated in FIGS. 3, 4, 7 and 8. Each pair of adjacent side members meet at a corner. One corner clip underlies each corner of each half-frame.

Each corner clip comprises a generally four-sided base portion 76. The base portion is shaped to underlie the side member face portions at the corners. First and second outer flanges 78 extend from an outer end of the base portion. First and second inner flanges 80 extend from the inner end of the base portion. A recess 82 is provided at the apex joint between outer flanges 78. A recess 84 is provided between inner flanges 80 at the apex joint therebetween.

The corner clip is mounted as best shown in FIGS. 3 and 4 with the outer flanges engaging flat portions 36 of adjacent side members. The inner flanges engage third portions 44 of adjacent side members. Recess 82 underlies the outer apex of each corner, while recess 84 underlies the inner apex of each corner. In this manner, the recesses can receive and retain caulk therein to enhance sealing of the frame assembly.

Holes 86 are formed in the outer flanges 78. Corresponding holes 88 are formed in the flat portions of each side member adjacent the longitudinal end of each side member. When the corner clip is properly located in the corner, respective holes 88 and 86 are aligned. A fastener 90, preferably in the form of a rivet, extends through the holes to secure the corner clips to the respective side members, and therefore, couple and reinforce the corners.

Each half-frame is initially formed from an identical elongated strip or blank of sheet metal. Preferably, each elongated metal strip is pre-painted and pre-finished.

Planar blank 92 is illustrated in FIG. 6 and is formed with a suitable number of mitered notches 94. Additionally, each longitudinal end 96 is provided with a mitered cut. Notches 94 and ends 96 are so formed that when the blank is bent to form the half-frames described above, the finished frame will have mitered corners.

In the illustrated embodiment, the rectangular frame assembly is of such size that it can be formed of a single, unitary or continuous strip. Thus, three intermediate notches are provided. The planar blank is bent along fold lines extending parallel to the longitudinal axis of the strip to form the appropriate cross-sectional configuration of the half-frame. Specifically, lip 38 is folded along fold line 39 relative flat portion 36. Additionally, the appropriate folds and bending is performed about fold lines 42, 46, 52 and 56 to form and position, respectively, the face portion, the third portion, the fourth portion and the fifth portion. Additionally, suitable folds and bends are made to form the recess 52.

Subsequently, the frame is folded at corner bend points 98 as indicated in FIG. 7 such that adjacent side members are perpendicularly arranged. The integral or unitary corner joints are then reinforced with corner clips 74 which are secured in place by rivets 90. Similarly, the open end corner is secured with a corner clip 74 as illustrated in FIG. 8.

After completion of the formation of the inner half-frame, with the addition of bores 58, and the outer half-frame, the two frames are located on opposite sides of translucent panel 26 with the faces of the panel abutting the fourth portions and the edges of the panel abutting the fifth portions of the half-frames. Each clip member 62 is aligned with one bore 58 to enable a screw to pass through the bore and threadedly engage opening 72. As the screw is tightened, the inner and outer half-frames are drawn to each other and to engage the edge projections formed by bent portions **16*a* and 18*a* in the door opening to secure the frame assembly within door opening 12 and to secure translucent panel 26 in frame assembly 10**.

To further insulate the frame, fiberglass insulation 100 is fitted between the face portions and the fourth portions of the half-frames before the half-frames are secured together.

A frame assembly 110 according to the second embodiment of the present invention is illustrated in FIGS. 9–13. Features which are the same as those of the first embodiment are identified with the same reference numbers. The second embodiment differs from the first embodiment in the configuration of the screw clips and of the face portion of each half-frame and in the connecting structure of the open corner of each half-frame, and in the use of caulking tape at the corners.

As best illustrated in FIGS. 9–11, screw clips 112 of the second embodiment are generally S-shaped with a plurality of angularly oriented planar sections. Each screw clip 112 comprises a first section 114, a second section 116 extending substantially perpendicular from first section 114 along a bend line 118, a third section 120 extending substantially perpendicularly from second section 116 along a bend line 122, and a fourth section 124 extending at an obtuse angle from third section 120 along a bend line 126. First section 114 includes an internally threaded opening 128.

Each screw clip 112 is mounted in outer half-frame 24 with its opening 128 aligned with one countersunk bore 58 in inner half-frame 22. To aid in aligning openings 128 and bores 58, each screw clip has a wedge-shaped recess 130 in the free end of first section 114 forming the outer edge 132 of the spring clip. A corresponding wedge-shaped indentation 134 is formed in outer half-frame 24 at the juncture of flat portion 36 and lip 38, and extends into the interior of the outer half-frame. The engagement of recess 130 and indentation 134 locates the respective clip in the outer half-frame to align opening 128 and bore 58 when the half-frames are assembled.

In the assembled position of each spring clip 112, first section 114 abuts outer half-frame lip 38 adjacent clip outer edge 132, and extends across the outer half-frame interior toward fifth portion 54. Clip second section 116 engages outer half-frame fifth portion 54 in surface-to-surface contact. Clip third section 120 overlies outer half-frame fourth portion 48. In this manner, the screw clips reinforce the half-frame fourth and fifth portions. Clip fourth section 124 underlies in surface-to-surface contact and reinforces a part of the half-frame fourth portion 48 forming recess 52. The free inner edge 136 of the spring clip abuts the inner surface of half-frame third portion 44.

The face portion 40 of the half-frames of frame assembly 110 have peripheral protrusions 138 along the face portion outer edges adjacent flat portions 36. These protrusions enhance the strength and appearance of the half-frames.

Frame assembly 110 omits the corner clips of frame assembly 10. The open end corner or corners of each half-frame of frame assembly 110 are connected by planar flanges 140, illustrated in FIG. 13. Flanges 140 are formed as unitary extensions of the sheet metal blanks used to form the half-frames. Each flange is bent to extend substantially perpendicularly from a half-frame flat portion 36 along a bend line 142. A hole 144 extends through the flange, and is aligned with a hole 146 in the flat portion of the adjacent side member of the half-frame. A fastener, such as a rivet or a screw, extends through aligned holes 144 and 146 to secure the mitered joint between the half-frame side members.

Caulking tape 148, as illustrated in FIG. 12, can be used to seal the mitered joints in the half-frames.

While particular embodiments have been chosen to illustrate the invention, it will be understood by those skilled in the art that various changes and modifications can be made therein without departing from the scope of the invention as defined in the appended claims.

What is claimed is:

1. A frame assembly for a door light, comprising inner and outer half-frames sandwiching a translucent panel therebetween, each of said inner and outer half-frames being separately and substantially similarly formed of sheet material and having a plurality of substantially similar side members defining a closed polygon;

each of said side members of said inner and outer half-frames including, in cross-section, a flat portion for supporting the frame in an opening in a support, a face portion extending in a generally perpendicular direction from said flat portion toward a center of said polygon, a third portion extending generally inwardly from said face portion toward the other half-frame to a position adjacent said translucent panel.

a fourth portion extending from said third portion in a direction generally parallel to said face portion and away from the center of said polygon, and a fifth portion extending inwardly from said fourth portion toward the fifth portion of the other half-frame and about a peripheral edge of said translucent panel; and fastener means coupling said half-frames and securing said half-frames in the support opening.

2. A frame assembly according to claim 1 wherein each of said half-frames are formed from sheet metal.

3. A frame assembly according to claim 1 wherein each of said half-frames are formed of a unitary and continuous blank of sheet metal.

4. A frame assembly according to claim 1 wherein said inner half-frame comprises bores extending through said face portions thereof; and said fastener means comprises elongated fasteners extending through said bores and clip means attached to said outer half-frame and coupled to said elongated fasteners.

5. A frame assembly according to claim 4 wherein each of said side members of said outer half-frame comprises a lip extending from an edge of said flat portion thereof remote from said face portion thereof generally toward said center of said polygon; and each said clip means comprising a clip member adjustably slidable along the respective side member and engaging surfaces of said lip and said fourth portion thereof remote from said inner half-frame.

6. A frame assembly according to claim 5 wherein each of said clip members comprises first and second perpendicularly oriented legs, each said first leg overlying the respective flat portion and having a free edge abutting the respective lip, each said second leg extending generally parallel to said face portions and having a free edge engaging the respective fourth portion and an opening receiving said elongated fastener.

7. A frame assembly according to claim 6 wherein said elongated fasteners and said openings in said clip members are threaded.

8. A frame assembly according to claim 5 wherein each of said clip members comprises planar first, second and third portions engaging said lip, said fifth portion and said fourth portion of said outer half-frame, respectively.

9. A frame assembly according to claim 8 wherein each said first portion comprises an opening receiving one of said elongated fasteners.

10. A frame assembly according to claim 8 wherein said clip members comprise recesses in outer edges thereof; and said outer half-frame comprises indentations extending inwardly and received in said recess to align said clip members relative to said elongated fasteners.

11. A frame assembly according to claim 1 wherein each of said half-frames comprises a plurality of corners between said side members which are adjacent with corner clips joining and reinforcing connections therebetween; and each of said corner clips comprises a base portion underlying said face portions, first and second outer flanges extending from an outer end of said base portion engaging the respective flat portions, first and second inner flanges extending from an inner end of said base portion engaging the respective third portions, said inner and outer flanges defining recesses for receiving caulk therebetween.

12. A frame assembly according to claim 11 wherein fasteners extend through said outer flanges and said base portions.

13. A frame assembly according to claim 1 wherein at least some corners between adjacent side members are formed by folded portions of said flat portions.

14. A frame assembly according to claim 1 wherein each of said half-frames comprises at least one open end corner between two adjacent ones of said side members, one of the adjacent side members having an integral flange extending therefrom, said flange being fixedly attached to the other of the adjacent side members.

15. A frame assembly according to claim 1 wherein each of said half-frames comprises a elongated recess in a transition portion between said third and fourth portions thereof.

16. A frame assembly according to claim 15 wherein said elongated recesses receive caulking material.

17. A frame assembly according to claim 15 wherein said elongated recesses comprise means for receiving clips securing a decorative grill over said translucent panel.

18. A method of forming a frame assembly for a door light, comprising the steps of:

forming elongated strips of sheet material, each with a longitudinal axis and each having mitered longitudinal ends and at least one mitered notch between the longitudinal ends, bending each elongated strip along fold lines extending parallel to the longitudinal axis to form a half-frame including a base portion, a face portion extending in a generally perpendicular direction from the base portion, a third portion extending at an angle from the face portion in the same general direction as the base portion, a fourth portion extending from the third portion in the same general direction as and parallel to the face portion and a fifth portion extending from the fourth portion generally parallel to and in the same direction as the base portion, such that the notch extends through the face portion, the third portion, the fourth portion and the fifth portion but not through the base portion, bending each base portion at a closed end of the notch to form a corner of each half-frame, locating a translucent panel between the fourth portions of a pair of the half-frames such that the fifth portions of the half-frames abut a peripheral edge of the translucent panel, and securing the half-frames and translucent panel together with fastener means.

19. A method according to claim 18 wherein the elongated strips are pre-painted prior to bending in the half-frames.

20. A method according to claim 18 wherein the half-frames are formed and coupled together without welding.

21. A method according to claim 18 wherein at least three mitered notches are formed in each of said elongated strips; and the base portion is bent at 90 degree angles at closed ends of the notches to form three corners of a rectangular half-frame, with a fourth corner formed by abutting the mitered longitudinal ends of each elongated strip.

22. A frame assembly for a door light, comprising:

inner and outer half-frames sandwiching a translucent panel therebetween, each of said inner and outer half-frames being separately and substantially similarly formed of sheet material and having a plurality of substantially similar side members defining a closed polygon;

each of said side members of said inner and outer half-frames including, in cross-section, a flat portion for supporting the frame in an opening in a support, a face portion extending in a generally perpendicular direction from said flat portion toward a center of said polygon, a third portion extending generally inwardly from said face portion toward the other half-frame to a position adjacent said translucent panel and a fourth portion extending from said third portion in a direction generally parallel to said face portion and away from the center of said polygon;

each of said side members of said outer half-frame having a lip extending from an edge of said flat portion thereof remote from said face portion thereof generally toward said center of said polygon;

said inner half-frame including bores extending through said face portions thereof; and fastener means coupling said half-frames and securing said half-frames in the opening of the support, said fastener means including elongated fasteners extending through said bores and clips attached to said outer half-frame and coupled to said elongated fasteners, each said clip being adjustably slidable along the respective side member and engaging surfaces of said lip and said fourth portion thereof remote from said inner half-frame.

23. A frame assembly according to claim 22 wherein each said clip comprises a first member extending generally parallel to said face portions with an opening receiving said elongated fastener, and a second member engaging the respective fourth portion.

24. A frame assembly according to claim 23 wherein said elongated fasteners and said openings in said clip members are threaded.

25. A frame assembly according to claim 22 wherein each said clip comprises first, second and third portions engaging said lip, lying adjacent a peripheral edge of said translucent panel and engaging said fourth portion of said outer half-frame, respectively.

26. A frame assembly according to claim 25 wherein each said first portion comprises an opening receiving one of said elongated fasteners.

27. A frame assembly according to claim 25 wherein said clips comprise recesses in outer edges thereof; and said outer half-frame comprises indentations extending inwardly and received in said recess to align said clips relative to said elongated fasteners.

* * * * *